United States Patent [19]

Arenz et al.

[11] Patent Number: 4,470,250

[45] Date of Patent: Sep. 11, 1984

[54] ELASTIC COVERED YARN

[75] Inventors: Gerd Arenz, Leverkusen; Hans R. Wiehe, Dormagen, both of Fed. Rep. of Germany

[73] Assignee: Bayer Aktiengesellschaft, Leverkusen, Fed. Rep. of Germany

[21] Appl. No.: 394,567

[22] Filed: Jul. 2, 1982

[30] Foreign Application Priority Data

Jul. 2, 1981 [DE] Fed. Rep. of Germany ..... 3126016

[51] Int. Cl.[3] ..... D02G 3/32; D02G 3/38

[52] U.S. Cl. ..... 57/225; 57/226; 57/230

[58] Field of Search ..... 57/225, 226, 243, 3, 57/6, 13, 15, 244, 230, 245, 315

[56] References Cited

U.S. PATENT DOCUMENTS

| | | | |
|---|---|---|---|
| 2,024,156 | 12/1935 | Foster | 57/225 |
| 2,231,808 | 2/1941 | Isaac | 57/225 |
| 2,488,941 | 11/1949 | Schneller | 57/230 X |
| 2,588,361 | 3/1952 | Cooper | 57/225 |
| 2,902,819 | 9/1959 | Ross | 57/230 X |
| 3,387,451 | 6/1968 | Cape et al. | 57/225 |
| 3,393,505 | 7/1968 | Reid et al. | 57/225 |
| 3,460,338 | 8/1969 | Morrison | 57/225 X |

*Primary Examiner*—Donald Watkins

*Attorney, Agent, or Firm*—Sprung, Horn, Kramer & Woods

[57] ABSTRACT

An elastic covered yarn the core of which is a wrapped yarn consisting of elasthan filament yarn having polyamide, polyester or viscose filament yarn as the sheath material, and which may be covered with different materials. This yarn has advantages in its properties and in processing compared to those covered yarns, the core of which is a bare elasthan filament yarn.

5 Claims, 1 Drawing Figure

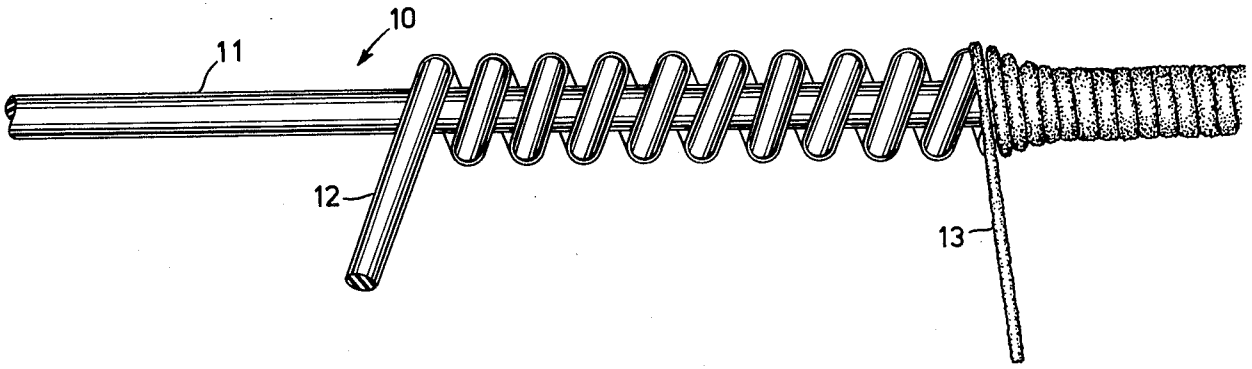
10
11
12
13

ELASTIC COVERED YARN

This invention relates to an elastic covered yarn, the core of which is a wrapped yarn of elasthan filament yarn having polyamide, polyester or viscose filament yarn as the sheath material. The wrapped yarn which is used as the core may be covered with different materials, for example, cellulose, mixed yarns of cellulose/-polyester or cellulose/polyacrylonitrile, wool, regenerated cellulose fibres (viscose) and mixtures with polyester or polyacrylonitrile.

Elastic covered yarns are known which comprises a bare elasthan filament yarn as the core and textile fibre yarns as the sheath material. Cloths made from such covered yarns are generally flexible, i.e., articles made of these fabrics exhibit elongations even under a low strain, and these elongations cause complications in the course of further processing. Moreover, it is known that textile sheet structures made of such covered yarns have a low modulus and thus generally have a lower resiliency. As a result of the ready deformability, the final quality of such covered yarns is unfavourably influenced in connection with irregular yarn tensile forces due to crepe effects. ("Bolder-stellen"), to fluctuations in width and to tight threads. The effect of these disadvantages in the production and processing of the known covered yarns is that these materials have not had the desired success in the production of elastic fabrics. The former elastic covered yarns have also been particularly unsatisfactory for piece dying. This is also the case with the elastic yarns which are described in British Pat. No. 949,326 and in U.S. Pat. No. 2,024,156 in which three yarns are twisted together to obtain a substantially three-component ply yarn having a elasthan filament yarn as the core and a spiral yarn or ply yarn structure.

It has now been found that the above-described disadvantages may be substantially avoided by using a wrapped yarn which has already been stabilized and consists of stretched elasthan filament yarn around which polyamide, polyester or viscose filament yarn is alternatively wound, instead of a bare elasthan filament yarn for the production of elastic covered yarns.

Covered yarns which have the above-described wrapped yarns as the core may be produced on regular ring spinning frames, unlike previously known covered yarns, without requiring the additional delivery mechanism which is essential for stretching when bare elasthan is used.

As a result of using elasthan wrapped yarns as the core in the elastic covered yarns, not only is a more stable yarn structure obtained, but also due to the additional wrapping of the elasthan yarn with fine filament yarn, covered yarns of this type have a higher modulus which is now required in many areas of use. Thus, sheet structures produced therefrom are less susceptible to undesirable and frequently uncontrollable deformations and have a higher inherent stability. Handling elastically extensible articles of a higher modulus, in particular, facilitates the outcome of the process in the course of ready-made production into articles of clothing. It has also been shown that the covered yarns according to the present invention which have a wrapped yarn core and an elastic extensibility of from 20 to 30% which is presently required in certain areas of use generally not only have a more stable structure, but mobilize a high resiliency when stretched due to the higher absorption of force. In operating terms, i.e., during processing of the covered yarns according to the present invention, a more favourable behaviour is established as a result of a lower thread break number, particularly when sized covered yarns according to the present invention are used as the warp in the production of fabrics.

The possibility which is afforded depending on the respective intended use of varying the extensibility ranges by a corresponding yarn structure provides the processor with a greater spectrum of possibilities for shaping textile sheet structures without the desired appearance of the product being impaired by considerable interferences in the yarn formation, for example by replacing a single yarn with an elastic ply yarn, or changing the yarn optics as a result of a higher twist.

The covered yarns according to the present invention having a wrapped yarn core also provides an improved overall final quality of the finished products, because the consequences of undesirable yarn deformations in the processing operation are less serious due to the higher modulus and the optics of the finished products also correspond to those of an inelastic product.

The covered yarns according to the present invention contain a wrapped yarn consisting of a elasthan filament yarn having a titre range of from 30 to 200 dtex, preferably from 45 to 160 dtex around which polyamide, polyester or viscose filament yarn of a titre range of from 15 to 90 dtex, in particular from 22 to 78 dtex is wound simply or crosswise.

For the production of the wrapped yarn 45, 80 or 160 dtex elasthan filament yarns around which 22, 33, 50 67 or 78 dtex polyamide or polyester filament yarn is wound once or twice in a simple or crosswise manner are preferred. The sheath materials for the production of the covered yarn are within the number range of from 40 to 10, preferably from 30 to 12.

A particular advantage of the covered yarn according to this invention is its applicability in piece dying, because the covering of the wrapped yarn by the sheath material is so complete that the wrapped yarn which may possibly not have been dyed does not shine through.

In the drawing, an elastic covered yarn 10 according to the present invention is depicted wherein a yarn core 11 of a stretched elasthan filament yarn has wrapped thereon a polyamide, polyester or viscose filament yarn 12. Such wrapped core is further covered with a covering material 13 of cellulose/polyester or cellulose/-polyacrylonitrile, wool, regenerated cellulose fibres or mixtures with polyester or polyacrylonitrile.

EXAMPLE

A twill was produced from an elastic covered yarn of the following structure:

Core:

Wrapped yarn consisting of 80 dtex elasthan single covered with 22 dtex f 7×1 Nylon, (900 T/m S)

Covered with 40 dtex×1 ($\hat{=}$Ne$_c$ 15/1) cotton, effected yarn thickness, stretched≈45 tex; $\hat{=}$Ne$_c$ 13.2

This elastic covered yarn was used as a warp material having 64 ends/inch in the finished fabric, after the yarn had previously been sized using normal products suitable for sizing cotton yarns. A textile fibre yarn consisting of polyacrylonitrile 62.5 tex×1 was used as the weft material. Set of the weft 61 picks/inch in the finished product. Weave 3/1 twill, m$^2$ weight 280 g.

The grey goods were washed and shunk, followed by a surface fixing with subsequent piece dying of the cotton using cellulose dyes, and then a final chemical finish specific to the article was applied. A denim-like fabric was thus obtained having an extensibility of from 25 to 30% which exhibited a high recoil capacity and a high force absorption when stretched.

We claim:

1. An elastic covered yarn comprising a wrapped yarn as the core, the wrapped yarn comprising a stretched elasthan filament yarn with a titre of from 30 to 200 dtex wrapped around with polyamide, polyester or viscose filament yarn with a titre of from 15 to 90 dtex, the wrapped yarn being covered with cellulose, mixed yarns of cellulose/polyester or cellulose/polyacrylonitrile, wool, regenerated cellulose fibers or mixtures with polyester or polyacrylonitrile, the covering material having a yarn-count-range of from 40 to 10.

2. An elastic covered yarn according to claim 1, in which the elasthan filament yarn has a titre range of from 45 to 160 dtex, the wrapping material has a titre range of from 22 to 78 detex and the covering material has a number range of from 30 to 12.

3. An elastic covered yarn according to claim 1 wherein said elasthan filament yarn is wrapped round with polyamide yarn.

4. An elastic covered yarn according to claim 1 wherein said elasthan filament yarn is wrapped round with polyester yarn.

5. An elastic covered yarn according to claim 1 wherein said elasthan filament yarn is wrapped round with a viscose filament yarn.

* * * * *